United States Patent [19]

Gerber

[11] Patent Number: 4,485,712

[45] Date of Patent: Dec. 4, 1984

[54] METHOD AND APPARATUS FOR HOLDING SHEET MATERIAL IN A SECTIONED VACUUM BED

[75] Inventor: Heinz J. Gerber, West Hartford, Conn.

[73] Assignee: Gerber Garment Technology, Inc., South Windsor, Conn.

[21] Appl. No.: 334,477

[22] Filed: Dec. 28, 1981

[51] Int. Cl.[3] ..... B26D 7/02

[52] U.S. Cl. ..... 83/451; 83/14; 83/29; 83/100; 83/925 CC

[58] Field of Search ..... 83/100, 29, 14, 451, 83/925 CC; 269/21

[56] References Cited

U.S. PATENT DOCUMENTS

| | | | |
|---|---|---|---|
| 3,598,006 | 8/1971 | Gerber et al. | 83/14 |
| 3,835,747 | 9/1974 | Bystron | 83/451 X |
| 4,345,496 | 8/1982 | Pearl | 83/100 |

*Primary Examiner*—Donald R. Schran
*Attorney, Agent, or Firm*—McCormick, Paulding & Huber

[57] ABSTRACT

An automatically controlled machine for cutting limp sheet material includes a vacuum bed defining a surface on which the sheet material is spread and held during cutting. A reciprocating cutting blade penetrates through the sheet material and the support surface of the vacuum bed as the blade is translated parallel to the support surface along lines of cut. A plurality of air-impermeable panels extend through the bed in spaced relationship to sectionalize the vacuum bed and permit the vacuum to be generated only in those portions of the bed where the cutting blade is operating. To prevent interference with the penetrating cutting blade, the panels are individually withdrawn from the bed when the cutting blade approaches.

19 Claims, 14 Drawing Figures

Fig_1
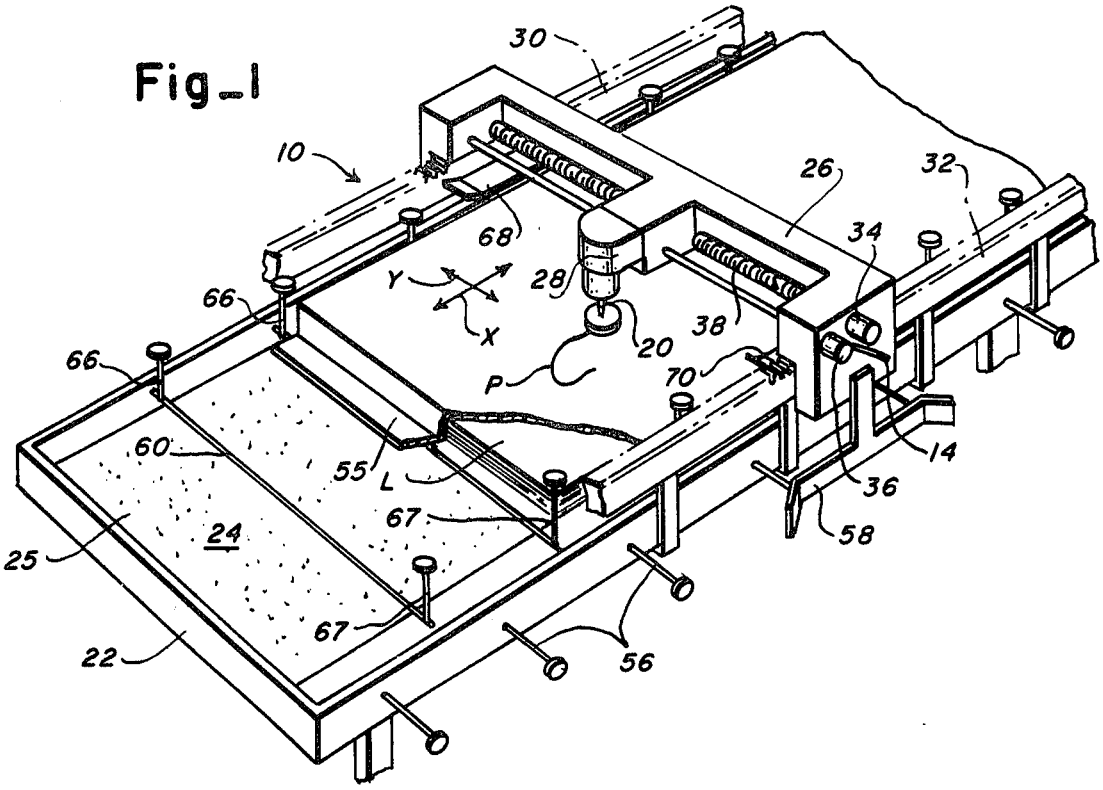
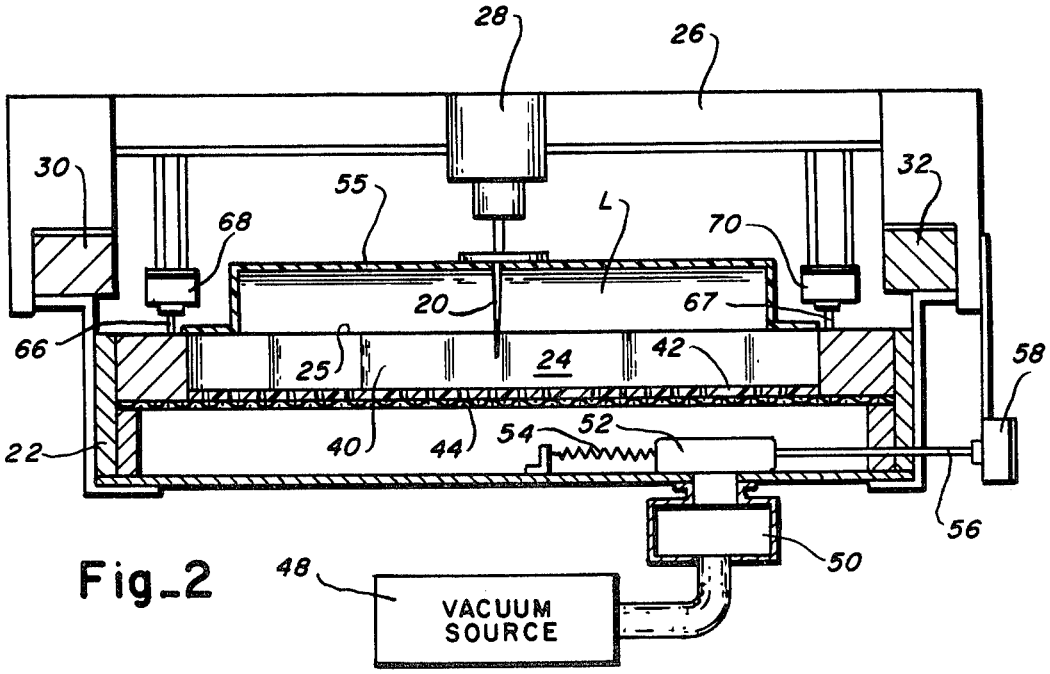
Fig_2

Fig_3
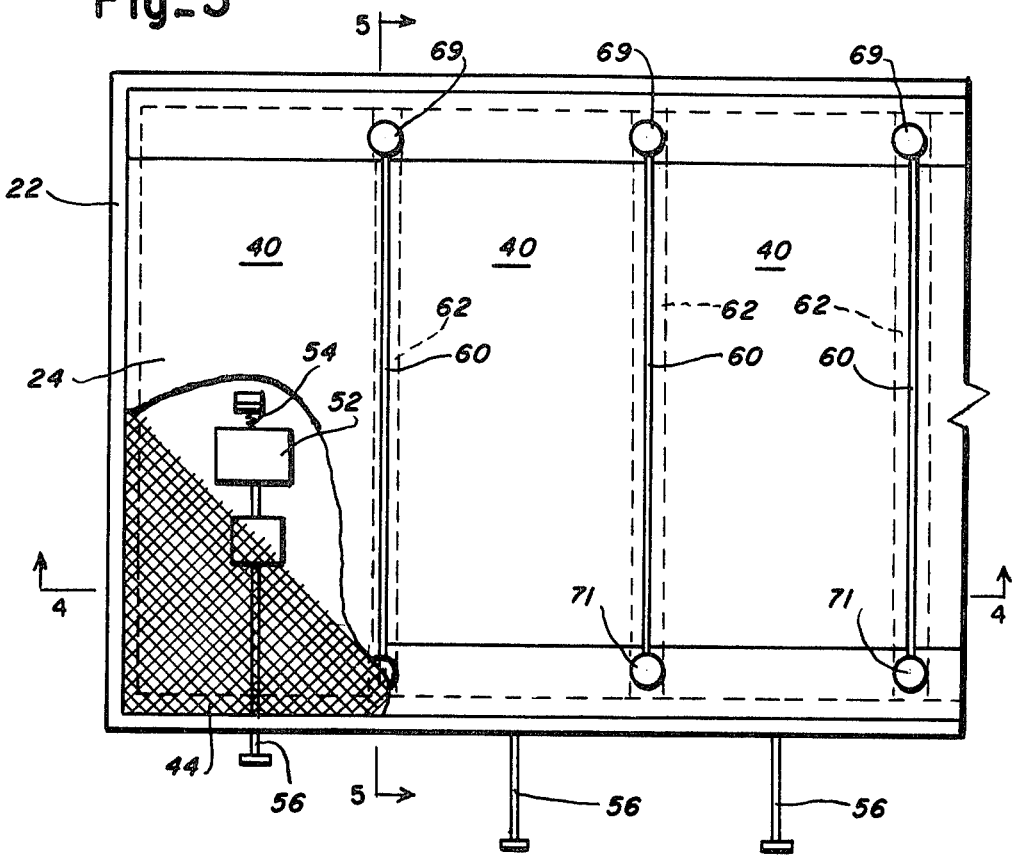
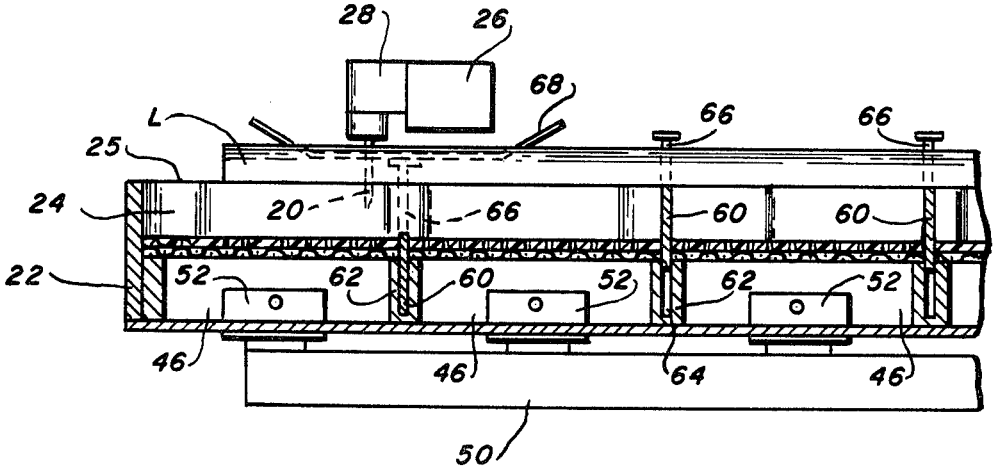
Fig_4

Fig_9
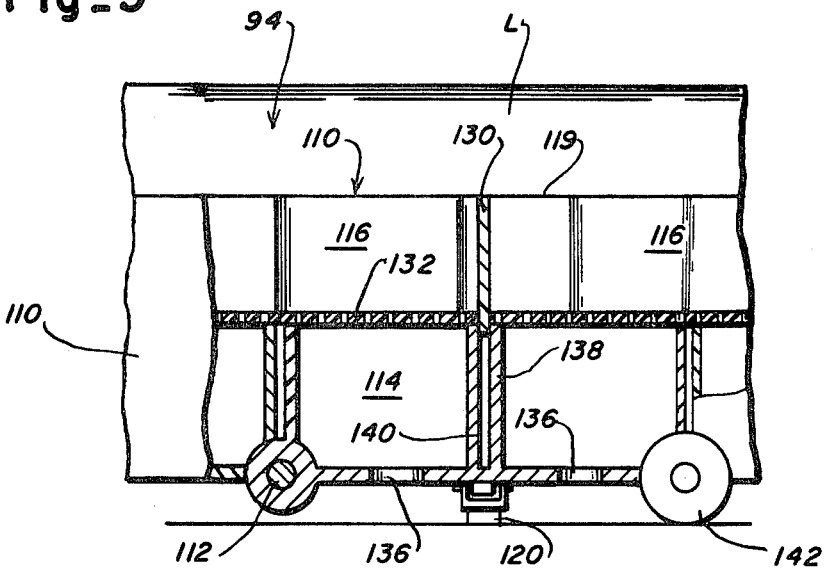
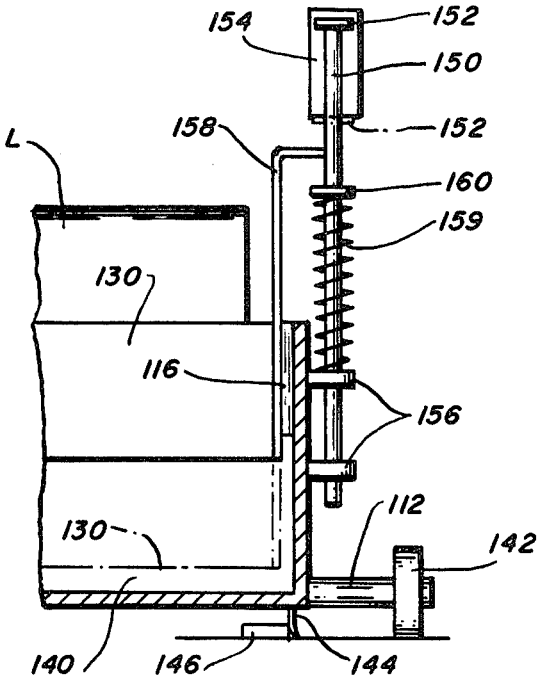
Fig_10
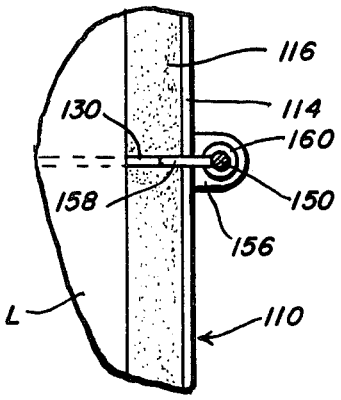
Fig_11

METHOD AND APPARATUS FOR HOLDING SHEET MATERIAL IN A SECTIONED VACUUM BED

BACKGROUND OF THE INVENTION

The present invention relates to automatically controlled cutting machines for cutting limp sheet material such as fabrics, paper, plastics, leathers, rubber and the like. More particularly, the present invention is concerned with vacuum beds that are utilized to firmly hold the sheet material in position as cutting takes place.

In prior art machines for cutting limp sheet material, vacuum has been used to hold the material firmly in place during cutting. U.S. Pat. No. 3,495,492, having the same assignee as the present invention, discloses such a machine. The sheet material is covered with an air-impermeable overlay to reduce the amount of air drawn through the material into the vacuum bed and generate higher holddown forces which compact the material. The vacuum system, however, must have a capacity sufficient to exceed the leakage rate through the overlay and material when cut and, at the same time, maintain adequate holddown forces.

To minimize the capacity of vacuum systems used in cutting tables, the vacuum beds were sectionalized, and valves were employed to generate the vacuum only in those sections of the bed where the cutting blade was operating. Customarily, the vacuum bed in a cutting table is comprised by bristled mats or blocks such as shown in U.S. Pat. Nos. 3,765,285 and 4,205,835. Bristles exhibit limited resistance to air flow in directions perpendicular to the support surface and also parallel to the support surface. Thus, if vacuum is applied in one section of a bed, air flow from the support surface overlying the section and also from adjacent sections is drawn through the vacuum system.

To reduce the capacity of the vacuum system due to horizontal air flow through the bed from adjacent sections, expendable panels or separators were inserted in the bristles between each section as shown in U.S. Pat. No. 3,765,289. Such panels were made of paper, rubber, thin plastic and the like, and were cut each time the blade passed between the different sections in a cutting operation. With extended use, the panels were destroyed and lost their effectiveness in restricting horizontal flow and thus required periodic replacement.

It is accordingly a general object of the present invention to provide a vacuum bed for holding limp sheet material with different sections of the table separated by panels that are not destroyed during cutting. More particularly, it is an object of the invention to provide a vacuum bed having panels which restrict horizontal flow of air through the bed during most of the cutting operation and which are withdrawn from the bed as the blade moves from one section of the bed to another.

SUMMARY OF THE INVENTION

The present invention resides in a method and apparatus for holding limp sheet material while the material is worked upon by a tool such as a reciprocating cutting blade. The cutting blade and the material are mounted for movement relative to one another in order to guide the cutting blade along predefined lines of cut.

The apparatus, which carries out the method, comprises support means or a table having an air-permeable bed defining a support surface on which the limp sheet material is spread in a work operation. Movable carriage means are connected with the blade and the support means to permit the blade and the sheet material to move relative to one another parallel to the support surface of the bed. In this manner, the blade can move along programmed lines of cut under numerical or other controls. Vacuum generating means are connected with the air-permeable bed for drawing a vacuum through the bed and holding the sheet material firmly against the support surface while the material is cut by the blade. The air-permeable bed may be comprised by a plurality of bristles through which the vacuum is drawn and which also permits the cutting blade to penetrate through the material and the support surface without damage to either the bed or the blade.

A plurality of air-impermeable partitions are mounted for movement into and out of the air-permeable bed. The partitions extend in generally perpendicular relationship with the support surface at spaced intervals so that the bed is effectively divided into a plurality of contiguous sections in which vacuum can be drawn without air flow between the sections. Actuating means are connected with the plurality of partitions for moving the partitions individually and independently into and out of the bed in the course of a cutting operation. Movement of the partitions is controlled so that air flow horizontally through the air-permeable bed into the section of the bed where the cutting blade is operating is prevented at each side of the cutting station. When the cutting blade advances between sections, the intervening partitions blocking air flow are withdrawn from the bed to avoid interference with the cutting blade.

In a preferred embodiment of the invention, vacuum is only applied to those sections of the bed where the cutting tool is operating, and thus the insertion and withdrawal of the partitions and the activating of the vacuum system within the different bed sections are all controlled in accordance with the cutting blade movements.

The movable partitions permit the capacity of the vacuum system to be selected in accordance with the demand of a limited portion of the vacuum bed where the cutting operation takes place because the partitions restrict air flow between bed sections. Adjacent sections of the bed remain deactivated, that is without vacuum, until the cutting blade moves into the overlying material. Since the partitions and the cutting blade do not interfere with one another, there is no damage to either the blade or the partitions and periodic replacement of the partitions is not necessary.

BRIEF DESCRIPTION OF THE DRAWINGS

FIG. 1 is a perspective view of an automatically controlled cutting machine embodying the present invention.

FIG. 2 is a sectional view of the cutting machine as seen along the sectioning line 2—2 in FIG. 1.

FIG. 3 is a top plan view, partially in section, showing the cutting table of the machine in FIG. 1.

FIG. 4 is an enlarged sectional view of the table as seen along the sectioning line 4—4 in FIG. 3 with the cutting tool and carriage shown above the support surface.

FIG. 9 is an enlarged fragmentary view of the conveyor in FIG. 8.

FIG. 10 is an enlarged fragmentary view of the conveyor along the sectioning line 10—10 in FIG. 9.

FIG. 11 is a fragmentary top plan view of the conveyor as shown in FIGS. 9 and 10.

DESCRIPTION OF THE PREFERRED EMBODIMENTS

Figure 5:
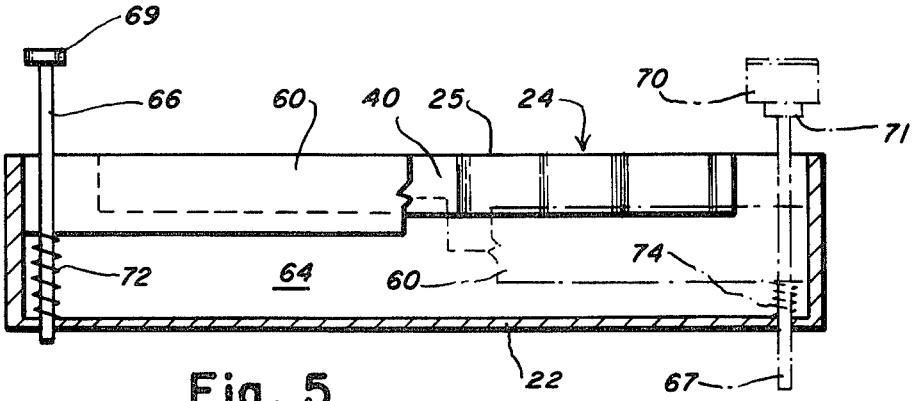
FIG. 5 is an enlarged sectional view showing the cutting table in FIG. 3 along the sectioning line 5—5.

FIG. 1 illustrates an automatically controlled cutting machine, generally designated 10, for cutting or performing other work on limp sheet material used in garments, upholstery and other products. The material is cut in multi-ply layups L in response to commands received through a control cable 14 from a controller (not shown). The controller takes data from a program tape and converts that data in accordance with a machine program into command signals that are supplied to the cutting table 10 for guiding a reciprocating cutting blade 20 along a cutting path P defined by the contours of a pattern piece.

The cutting machine 10 includes a table 22 having a penetrable vacuum bed 24 defining the support surface on which the sheet material is spread in the layup L. The bed 24 may be comprised of an open-cell foam material or, preferably, a bed of bristles which are easily penetrated by the cutting blade 20 without damage to either while the cutting path P is traversed. The bed also includes a vacuum system (shown and described below in connection with FIGS. 2, 3 and 4) similar to that illustrated and described in greater detail in the above-referenced U.S. Pat. No. 3,495,492. The vacuum system compacts the limp sheet material and holds the sheet material firmly in position on the support surface 25 of the table.

The cutting blade 20 in a preferred embodiment is a knife blade suspended above the support surface of the table 22 by means of an X-carriage 26 and a Y-carriage 28. The X-carriage translates back and forth in the illustrated X-coordinate direction on a set of racks 30, 32 which are engaged by an X-drive motor 34 energized by command signals received through the cable 14. The Y-carriage 28 is mounted on the X-carriage 26 for movement relative to the X-carriage in the Y-coordinate direction, and is translated by a Y-drive motor 36 and a lead screw 38 connected between the motor and carriage. Like the X-drive motor, the Y-drive motor is also energized by command signals received through the cable 14. Thus, coordinated movements of the carriages 26 and 28 translate the cutting blade along a cutting path P at any area of the support surface 25.

The cutting blade 20 is suspended in cantilever fashion from the Y-carriage 28 for elevating the sharp, leading cutting edge into and out of cutting engagement with the layup L of sheet material on the table 22. The blade 20 is a reciprocating cutting blade, and in the course of a cutting operation, the blade penetrates not only through the sheet material in the layup L, but also through the support surface 25 into the penetrable vacuum bed 24.

As shown in the embodiment of FIGS. 2–5, the penetrable vacuum bed 24 is comprised by a bed of bristles 40 projecting upwardly from a perforate base 42 and generally defining at their upper ends the support surface 25. The base 42 is mounted on a lattice or screen 44 to permit unimpeded flow of air from the support surface 25 perpendicularly downward through the base 42 and the screen 44 into one of a plurality of vacuum chambers 46 in the base of the table 22. A vacuum source or pump 48 is connected with each of the vacuum chambers 46 through a manifold 50 and slide valves 52 located respectively in each of the chambers. The slide valve 52 is biased toward a normally closed position by a spring 54 and is actuated to an open position, as illustrated in the sectioned portion of FIG. 3, by means of an actuating plunger 56 and a cam 58 suspended from the X-carriage 26. The cam depresses the plunger 56 and opens the slide valve 52 of a given chamber 46 to evacuate the chamber and overlying portions of the bed 24 and the sheet material thereon. The vacuum holds the sheet material firmly in position, and to improve the holddown forces, the layup L is covered with an expendable, air-impermeable overlay such as a sheet of polyethylene which is also cut with the sheet material. It will be observed that the cam 58 depresses only those plungers which evacuate the chambers and overlying portions of the bed which lie in the immediate vicinity of the cutting blade. The more remote portions of the bed are, therefore, not activated or evacuated until the cutting blade moves into those areas.

In accordance with the present invention, a plurality of air-impermeable partitions or panels 60 are mounted in spaced and parallel relationship in the vacuum bed and are controllably inserted into the bristles to divide the bed into a consecutive series of sections and inhibit the flow of air between each section parallel to the support surface. It will be observed most clearly in FIG. 4 that the panels 60 are located at each wall 62 separating the various vacuum chambers 46. Each wall contains an opening or slot 64, and the panels 60 are movable between an elevated position within the bristles 40 and a lowered or withdrawn position in the slots 64. When the panels are in the elevated position within the bristles, the panels are generally perpendicular to the support surface and impede the flow of air horizontally between different sections of the bed. When the panels are in the lowered position, the reciprocating cutting blade 20 may pass between the different sections without interference with the panels.

As shown most clearly in FIG. 5, each of the air-impermeable panels 60 has an actuating plunger 66 connected with the panel at one side of the table and a similar plunger 67 at the opposite side of the table. The plunger 66 projects upwardly above the support surface 25 of the bed and has a cam follower 69 at the top for engagement with an actuating cam 68 (FIGS. 1 and 2) suspended at one end of the X-carriage 26. Similarly, the plunger 67 at the opposite side of the table projects upwardly above the support surface 25 and has a cam follower 71 for engagement with an actuating cam 70 suspended from the other end of the X-carriage 26 in transverse alignment with the cam 68. As a result, when the carriage 26 advances over the cutting table during a cutting operation, the actuating cams engage the cam followers of the plungers 66 and 67 in the vicinity of the cutting blade and depress the panels from the elevated position in the bristles to the lowered position. The panel shown in the left portion of FIG. 5 is in the elevated position and in the right portion is depressed to the lowered position, although it will be understood that the split representation of the panel is solely for purposes of illustration, and in the cutting machine, both ends of the panel are actuated together by the transversely aligned cams.

When the X-carriage 26 has moved the cutting blade to another portion of the cutting table 22, return springs 72 and 74 at opposite ends of panel 60 raise the entire panel from the lowered position to the elevated position. In the elevated or inserted position, the upper edge of the panel is preferably coplanar with the support surface 25 and effectively impedes the flow of air between contiguous sections of the bed through the bristles. In the lowered or withdrawn position of the panel, the upper edge of the panel is below the maximum depth of penetration of the cutting blade and therefore the cutting blade may pass between the different sections without interference with the panels.

As shown in FIGS. 1 and 4, the cams 68 and 70 lower only one of the panels 60 at a time. It is, however, contemplated that with smaller sections and closely spaced panels, the cams may actuate more than one of the panels at a time and with larger sections and more widely spaced panels, there may be positions of the cutting blade near the middle of a section where no panel is withdrawn from the bristles. In this regard, the word "withdrawn" refers to the lowered panel position whether the panel is actually depressed or pulled to that position, and the word "inserted" refers to the elevated position whether the panel is lifted or pushed into that position.

Since the lowered panels allow horizontal flow of air between adjacent sections of the bristles, it is preferably that the positioning of the cam 58 actuating the slide valves 52 be coordinated with the positioning of the cams 68 and 70 which withdraw the panels. In particular, before a panel is lowered, it is preferable that the slide valve for bed sections on opposites sides of the panel be open to prevent any of the leakage between sections from interfering with the material holddown forces. Opening the valves in advance of the panel withdrawal does not substantially increase the flow of air through the vacuum source unless the sections are extremely large. In the same respect, a slide valve should not be closed until after the cutting blade has moved away and the panel has been returned to the elevated position within the bristles. In this manner vacuum is generated in the section of the bed toward which the blade is moving before the panel is lowered, and is not terminated in the section from which the blade is moving until after the panel has been elevated.

Figure 6:
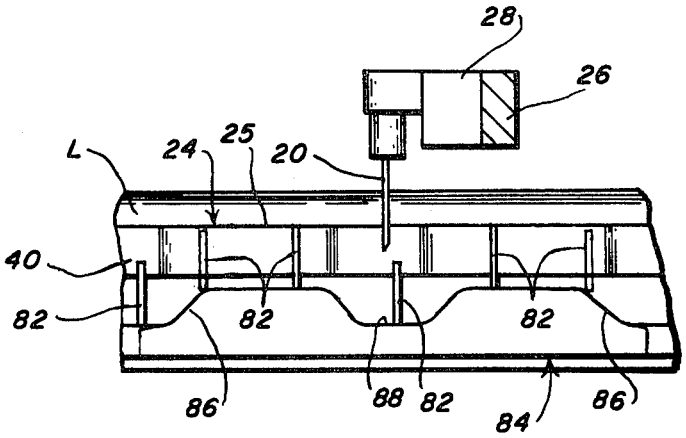
FIG. 6 is a schematic view showing an alternate embodiment of the invention in a side elevation view of the machine.

FIG. 6 illustrates a further embodiment of the automatically controlled cutting machine with air-impermeable panels that are raised and lowered in the vacuum bed. The machine, generally designated 80, is shown schematically but contains a cutting tool in the form of the reciprocating cutting blade 20, tool carriages 26 and 28 and a vacuum bed 24 as in the machine 10 of FIG. 1. The vacuum bed 24 is also provided with a plurality of air-impermeable panels 82 which are raised and lowered in the bristles of the bed in order to restrict the flow of air horizontally through the bristles and permit the cutting blade to penetrate the bed without interference with panels. However, in this embodiment the panels 82 are normally stored in the lowered position, and are inserted upwardly into the bristles generally flush with the support surface 25 only at locations immediately adjacent each side of the cutting station. For this purpose, cams 84 (only one visible) are suspended from each end of the X-carriage 26, and each cam 84 contains two lifting lobes 86 which raise the panels 82 at each side of the cutting blade. Between the lobes 86, the profile of the cam 84 defines a depression 88 which allows the air-impermeable panels 82 to be lowered within the bristles and the cutting blade to pass in an unimpeded manner.

In the cutting machine 80, it is essential that each cam lobe 86 be of a length sufficient to maintain at least one of the panels 82 in the raised position at all times. Otherwise, horizontal flow of air is not impeded. The panels may be lowered due to their own weight, but it is preferable that means such as a return spring be utilized to ensure that the panels are removed from the elevated position in the bristles when the depression 88 in the cams allows.

Figure 7:
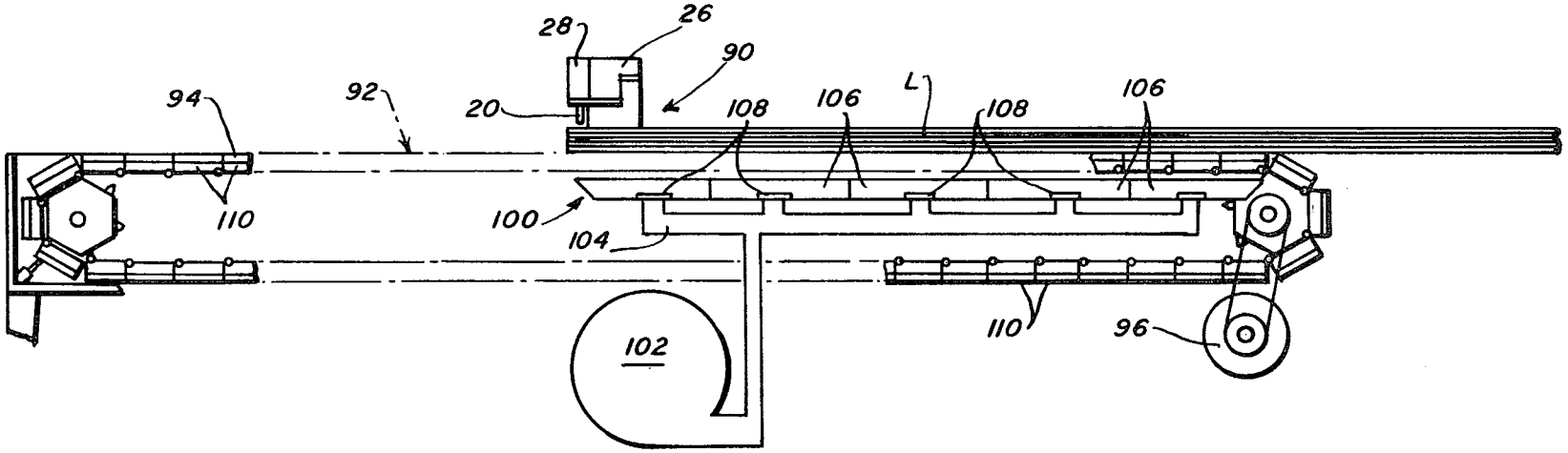
FIG. 7 illustrates another automatically controlled cutting machine embodying the present invention.

FIG. 7 illustrates still a further embodiment of the invention in an automatically controlled cutting machine generally designated 90. The machine 90 includes the reciprocating cutting blade 20 which is supported by means of an X-carriage 26 and a Y-carriage 28, and the cutting blade is moved automatically back and forth in cutting engagement with the sheet material L in substantially the same manner as described in the embodiments of FIGS. 1 and 6. The layup L is supported on a conveyor table 92 having a conveyor 94 which loads the layup L onto the right-hand portion of the table for cutting and unloads the cut pattern pieces at the left-hand portion of the table. With the conveyor table, it is possible to cut markers or an array of pattern pieces having a length many times greater than the segment of the table 92 on which the cutting takes place. After one portion or 'bite' of the marker is cut, the conveyor 94 on which the layup L rests is activated through the conveyor drive motor 96 and the cut material is moved from the right-hand to the left-hand portion of the table while new, uncut material is pulled onto the right-hand portion.

The right-hand portion of the cutting table includes a vacuum system 100 which is positioned below the conveyor 94 with a vacuum pump 102, a main conduit or manifold 104 and a plurality of vacuum chamber 106 which are connected with the conduit 104 through slide valves 108. The slide valves 108 are constructed and actuated in substantially the same manner as the slide valves 52 illustrated in FIGS. 2–4.

The links 110 of the conveyor 94 comprise a penetrable vacuum bed in conjunction with the vacuum system 100. As shown in greater detail in FIG. 8, the links 110 are hinged or pivotally connected together by means of pins 112, and each link is comprised of a lower box frame 114, some of which are shown in section, and an upper portion comprised by bristle mats or blocks 116 having substantially the same construction as the bristles 40 and base 42 shown in FIGS. 1–4.

The run of the conveyor 94 located on the upper side of the table 92 is supported by stationary framework at each side of the table for movement when the conveyor drive motor is energized. Consecutive links along the upper run join one another in closely spaced relationship so that the bristle mats 116 in one link contact or merge with the mats of adjacent links. In this manner the links effectively define a continuous support surface 119 on which the layup L of sheet material rests while the cutting blade 20 penetrates through the material and the support surface in a cutting operation.

The vacuum system 100 compresses the sheet material by drawing air from the support surface 119 downwardly through the mats 116 and the box frames 114 into the chambers 106. For this purpose, the floors of the box frames have apertures 136, and the upper walls of the chambers 106 are provided with apertures 118. Each link 110 includes a transverse seal 120 that extends along the underside of each box frame from one side of the cutting table to the other. The apertures 118 and seals 120 are positioned and dimensioned so that air may always be drawn through the bristles and into a vacuum chamber 106 at any parked position of the conveyor 94. It will be understood that the seals 120, the vacuum chambers 106 and the slide valves 108 permit evacuation of the conveyor 94 to be limited to sections of the vacuum bed over which the cutting blade 20 is operating. For a more complete description of a conveyor table 92, reference may be had to U.S. patent application Ser. No. 207,873, filed Nov. 11, 1980 and having the same assignee.

In accordance with the present invention, a plurality of air-impermeable panels 130 are mounted in the links 110 for movement between a raised and lowered position within the bristle mats. In the raised position, the panels restrict the flow of air horizontally between the several links of the conveyor 94 and in the lowered position, the panels permit the cutting blade 20 to penetrate through the layup L of sheet material into the bristles during a cutting operation without interference with the panels.

FIGS. 9, 10 and 11 show the details of a link 110 and the operating mechanism which allows the panel 130 to be raised and lowered in the bristle mats 116. As shown in FIG. 9, the bristle mats 116 are mounted on the upper portion of the box frame 114 and include a perforate base 132 through which air is drawn from the support surface 119 defined by the upper ends of the bristles. The plurality of apertures 136 in the floor of the box frame draw air downwardly into the stationary portion of the vacuum system.

A partition 138 is located in the central portion of the box frame and projects upwardly from the floor to support the bristle mats that are situated at each side of the air-impermeable panel 130. A slot 140 within the partition 138 serves as a recess into which the panel 130 is lowered when the cutting blade must pass through the bristles in a cutting operation. The bristle mats immediately adjacent the panel 130 are spaced from one another by an amount sufficient to allow the panel to be inserted between the bristles with little or no deflection, and yet the spacing is so small that any discontinuity in the support surface 119 when the panel 130 is withdrawn, is of no significant consequence.

It will be apparent that the weight of the sheet material on top of the conveyor 94 and the holddown forces must be supported from the remaining portions of the table, and for this purpose, wheels 142 are mounted on the connecting pins 112 at each end. The weight of the layup L and the conveyor 94 in addition to the holddown forces created by the vacuum system, is all supported on the wheels with limited pressure applied through the seal 120 to the table. A flap seal 144 in FIG. 10 extends transversely across each end of the box frame and slides against a seal block 146 on the base of the table to close the space that is evacuated between the box frames 114 and the vacuum chambers below the conveyor.

Figure 8:
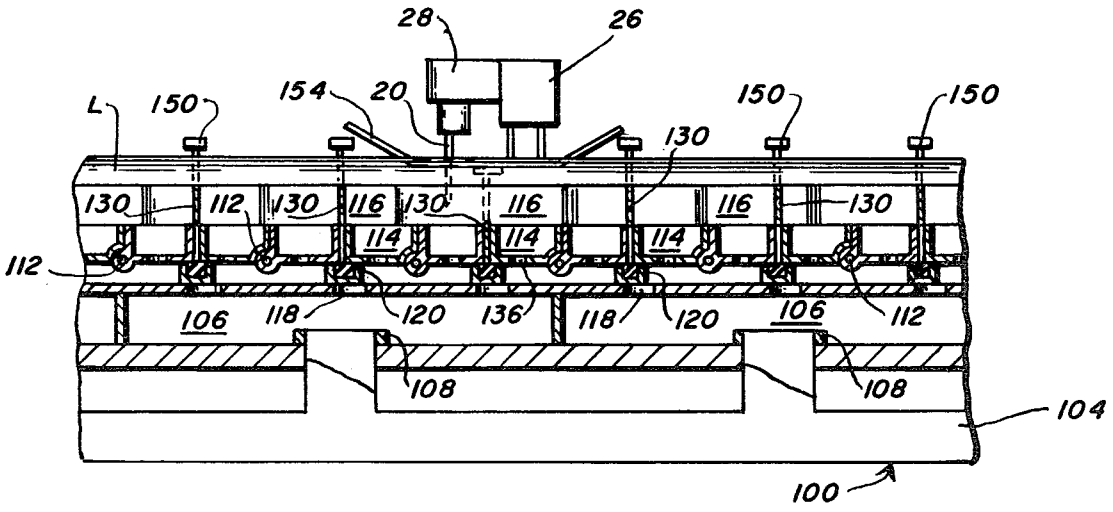
FIG. 8 is a fragmentary side elevation view of the cutting table in FIG. 7 in section.

To actuate the air-impermeable panel 130 between the raised and lowered positions, an actuating plunger 150 is secured to the side of the box frame 114 as shown in FIGS. 10 and 11, and the upper end of the plunger includes a cam follower 152 which is engaged by a cam 154 suspended from the X-carriage 26 shown in FIG. 8. In FIG. 10, the actuating plunger 150 is mounted in a pair of lugs 156 on the outside of the box frame for sliding movement in a direction generally perpendicular to the support surface 119 of the conveyor. The panel 130 is connected with the plunger 150 by means of a connecting strut 158 which bridges the vertical side wall of the box frame 114. A return spring 159 is mounted coaxially about the plunger and is interposed between the upper lug 156 and a stop washer 160 to urge the panel into the elevated position. A similar set of lugs, plunger, strut and spring connect with the opposite end of the panel (not shown).

With the panel mounted and connected to the plunger 150 as described, the panel normally rests in the elevated position within the bristles as shown in FIG. 9, and when the carriage 26 translates the cutting blade into the vicinity of the panel, the plungers 150 lower the panel into the slot 140 of the box frame 114. After the cutting blade and cam have moved over the panel, the cam 154 allows the return spring 159 to lift the panel back to the raised position and block the flow of air horizontally through the bristles. Seals between the ends of the panel and the ends of the box frame may be provided to restrict the flow of air around the panel. Similarly, seals may be provided between the ends of adjacent box frames to prevent leakage from one frame to the next or from outside of the frames.

Figure 12:
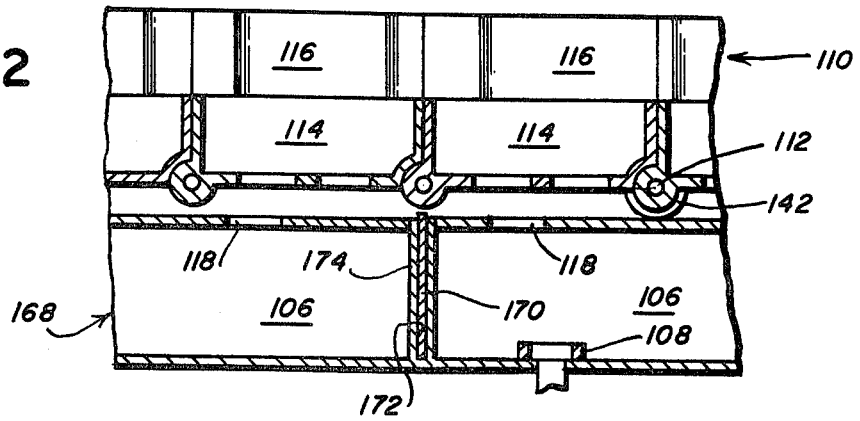
FIG. 12 is an enlarged fragmentary view of a table conveyor showing showing still a further embodiment of the invention.
Figure 13:
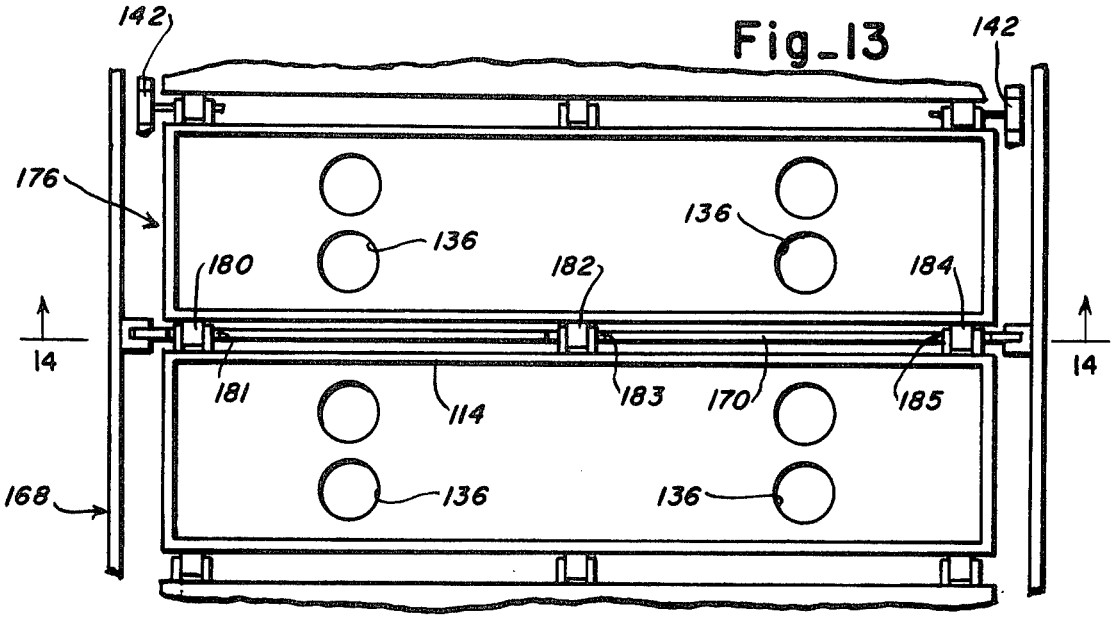
FIG. 13 is a fragmentary top plan view of the conveyor shown in FIG. 12.
Figure 14:
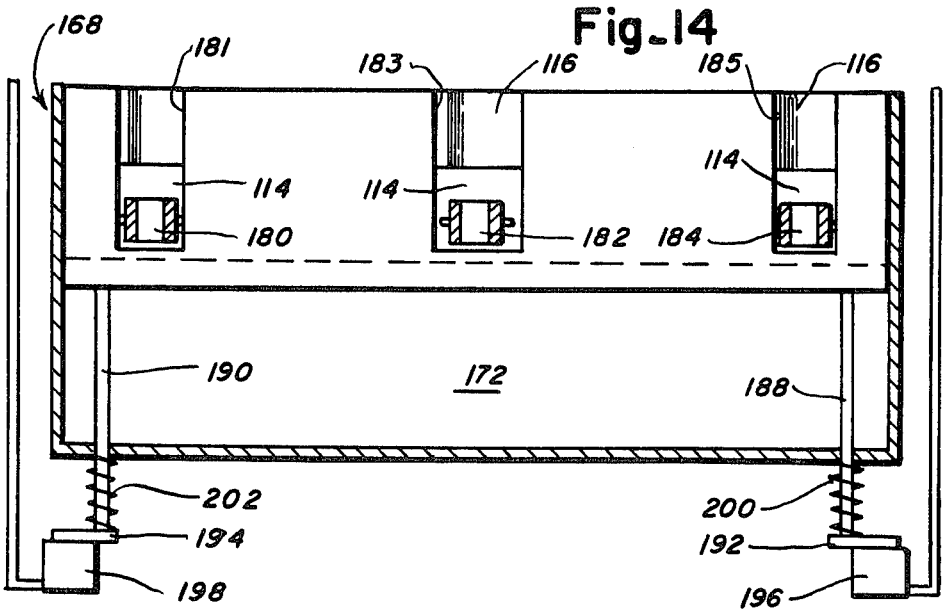
FIG. 14 is a sectional view of the conveyor and cutting table as seen along the sectioning line 14—14 in FIG. 13.

FIGS. 12, 13 and 14 illustrate another embodiment of the invention that is used with a conveyor table 168 similar to the table 92 shown in FIGS. 7 and 8. As shown most clearly in FIG. 12, however, an air-impermeable panel 170 is mounted within a slot 172 defined by the partition 174 between adjacent vacuum chambers 106. Correspondingly, there are no panels mounted within the bristle mats 116 or seals on the box frames 114 which comprise the links 110 of the conveyor 176.

As shown in the view of the conveyor 176 in FIG. 14 with the bristle mats removed, the box frames 114 are connected by three hinges 180, 182 and 184. When it is desired to insert the panels 170 within the portion of the vacuum bed defined by the conveyor 176, the conveyor must first be positioned with the hinges or slots between the links 110 in registration with the slots 172 in the base of the table 168. It is not essential that there be one panel 170 and slot 172 for each link 110 of the conveyor, and depending upon the area of the conveyor in which the vacuum is to be limited and the length of the links 110, one panel for every three or more links may be satisfactory.

Each of the panels 170 contains notches 181, 183, 185 which correspond with the hinges 180, 182, 184 so that when the panel is raised into its flow-restricting position between the bristle mats 116 as shown in FIG. 14, the hinges are received in the notches without interference. Although the notches in the panels 170 allow limited leakage between the bristle mats 116 of adjacent links, that leakage is localized and minimized.

Actuation of the panels 170 is accomplished by means of plungers 188, 190 extending downwardly through the floor of the table from the lower edge of the panel. Cam followers 192 and 194 are connected to the lower ends of the respective plungers and two lifting cams 196, 198 cooperate with the respective followers to lift the panels upwardly as shown. The lifting cams are suspended from the X-carriage 26 in substantially the same manner as the cams 68, 70 in FIG. 1 or cam 154 in FIG. 8. Interposed between the cam followers 192, 194 and the base of the vacuum chambers are return springs 200, 202 which normally urge the panel 170 downwardly to the retracted position illustrated in FIG. 12 when the cams 196, 198 and supporting carriage have moved along the table beyond the panel.

The embodiment of FIGS. 12–14 has the advantage that the partitions and seals need not be carried with the conveyor and, hence, the links 110 may be of a more elementary construction. On the other hand, the embodiment of FIGS. 8–11 has the advantage that the conveyor may be stopped at any rest position for cutting since there is no need to register the air-impermeable panels 170 with slots between the links 110 of the conveyor 176.

In summary, method and apparatus for holding limp sheet material during a work operation have been disclosed in several embodiments. In each case, a vacuum bed is provided with different sections that are separated from one another by air-impermeable partitions or panels to limit the flow of evacuating air between sections. When a cutting tool, such as a penetrating cutting blade, approaches a panel, the panel is retracted from the bed to avoid interference.

While the present invention has been described in a preferred embodiment, it will be understood that numerous modifications and substitutions can be had without departing from the spirit of the invention. For example, although cams connected with the X-carriage have been employed for moving the air-impermeable panels between the elevated, flow-restricting position and the lowered, non-restricting position, it should be understood that other types of hydraulic, pneumatic, electric or fluid actuators may also be employed. Such other actuators may be triggered into operation by mechanical or electrical sensors which detect carriage motion or actuating signals may be derived directly from the program which controls movement of the cutting blade in the X-coordinate direction. Accordingly, the present invention has been described in several embodiments by way of illustration rather than limitation.

I claim:

1. Apparatus for holding limp sheet material while the material is worked with a tool, the material and the tool being mounted for movement in controlled relationship relative to one another comprising:

support means having an air-permeable bed defining a support surface on which limp sheet material is spread in a work operation;

movable carriage means connected with the tool and the support means to permit the tool and the sheet material to move relative to one another parallel to the support surface in a work operation, whereby the tool may operate on the material at different work stations;

vacuum generating means connected with the air-permeable bed for drawing a vacuum at the support surface through the bed to hold limp sheet material on the support surface firmly in position while the material is worked upon by the tool;

a plurality of air-impermeable partitions mounted at spaced intervals and in generally perpendicular relationship with the support surface for individual movement into and out of the air-permeable bed in a direction perpendicular to the support surface whereby the bed and the support surface can be divided into a plurality of contiguous sections separated by the air-impermeable partitions and thereby render the bed capable of drawing a vacuum in the overlying material without air flow between contiguous sections; and actuating means connected with the plurality of partitions for moving the partitions individually and independently into and out of the air-impermeable bed in the perpendicular direction, the actuating means being operatively associated with the movable carriage means to position the partitions in the air-permeable bed at opposite sides of the tool work station and out of the bed at the work station whereby air flow through the whole bed toward the work station is prevented during a work operation.

2. Apparatus for holding limp sheet material as defined in claim 1 wherein the vacuum generating means includes a vacuum source, conduits between the source and each of the contiguous sections of the air-permeable bed, and valve means in the conduits also operatively associated with the movable carriage means for drawing a vacuum at the support surface of the individual sections in the vicinity of the tool work station.

3. Apparatus for holding limp sheet material as defined in claim 1 wherein: the actuating means includes cam followers mounted on the plurality of air impermeable partitions; and the movable carriage means includes a cam engagable with the cam followers to mechanically move the partitions into and out of the bed.

4. Apparatus for holding limp sheet material as defined in claim 3 wherein:

the air-impermeable partitions are biased into positions within the air-permeable bed; and the cam followers on the partitions and the cam on the movable carriage means cooperate to move the partitions out of the bed in the vicinity of the tool work station.

5. Apparatus for holding limp sheet material as defined in claim 3 wherein:

the air-impermeable partitions are biased out of positions within the air permeable bed; and the cam followers on the partitions and the cam on the movable carriage means cooperate to move the partitions into the bed at the opposite sides of the tool work station.

6. Apparatus for holding limp sheet material while the material is worked upon with a tool as defined in claims 1 or 2 wherein:

the tool is a cutting tool penetrable through the limp sheet material and the support surface of the support means in a tool operation; and the air-permeable bed of the support means is a penetrable bed penetrated by the cutting tool.

7. Apparatus for holding limp sheet material as defined in claim 6 wherein the cutting tool is a reciprocated cutting blade and the penetrable bed is comprised by bristles having free ends lying substantially in a common plane to define the support surface of the bed.

8. Apparatus for holding limp sheet material as defined in claim 1 wherein:

the support means comprises a support table with a conveyor having an air-permeable body movable over the table and defining the support surface for the limp sheet material; and the plurality of air-impermeable partitions are mounted in the conveyor movement into and out of the body and are carried with the conveyor movements over the table.

9. Apparatus for holding limp sheet material as defined in claim 1 wherein:

the support means comprises a support table with a movable conveyor having an air-permeable body with one portion extending over the table and defining the support surface for the limp sheet material, the body also having a plurality of slots extending perpendicularly from the support surface through the bed at spaced intervals between contiguous sections of the bed and support surface; and the plurality of air-impermeable partitions are mounted in the support table under the conveyor body portion extending over the table and at spaced intervals corresponding to the intervals of the slots through the bed for movement from the table into and out of the slots of the bed.

10. In an apparatus for cutting limp sheet material and having a reciprocated cutting blade and an air-permeable vacuum bed defining a support surface penetrated by the blade during cutting and on which the material is positioned and held for cutting, the reciprocated cutting blade and the material being advanced relative to one another in cutting relationship by means of a movable carriage and controlled drive means connected with the carriage, the improvement comprising:

partitioning means for dividing the air-permeable vacuum bed into a plurality of individual sections and restricting air flow through the bed between the sections, the partitioning means including an air-impermeable panel mounted for movement while the bed remains stationary, between a raised position within the air-permeable bed and restricting air flow between the adjacent individual sections, and a lowered position in non-interfering relationship with the reciprocated cutting blade as the blade penetrates the support surface of the bed while cutting the sheet material; and panel actuating means connected with the air-impermeable panel of the partitioning means for moving the panel between the raised and lowered positions in accordance with movement of the cutting blade over the vacuum bed while cutting the sheet material.

11. In an apparatus for cutting as defined in claim 10, the improvement wherein:

the actuating means for moving the air-impermeable panel between the raised and lowered positions is responsive to the controlled drive means connected with the carriage.

12. In an apparatus for cutting as defined in claim 11, the improvement wherein the carriage includes a cam engagable with the panel of the partitioning means to move the panel between the raised and lowered positions as the carriage moves, and the controlled drive means includes motor means connected in driving relationship with the carriage for moving the cutting blade and sheet material in cutting relationship.

13. In an apparatus for cutting as defined in claim 10, the improvement wherein:

vacuum generating means and vacuum conduit means comprised by a plurality of conduits connected with the vacuum bed sections are provided to evacuate the bed sections and produce low pressure regions at the support surface of the bed;

valve means including a plurality of valves are mounted in the conduit means for selectively opening and closing the conduits and evacuating different sections of the vacuum bed; and valve actuating means are connected with the valve means for selectively opening and closing the conduits and valves also in accordance with movement of the cutting blade while cutting the sheet material.

14. In an apparatus for cutting limp sheet material as defined in claim 13, the improvement wherein both the panel actuating means and the valve actuating means operate in response to movement of the cutting blade into the vicinity of the panel and bed sections respectively.

15. In an apparatus for cutting limp sheet material as defined in claim 10, the improvement wherein:

the carriage is mounted for movement along the vacuum bed in a given direction; and the partitioning means includes a plurality of air-impermeable panels extending through the bed in the raised position, the panels extending in spaced and parallel relationship with one another and extending generally perpendicular to the given direction to divide the bed into a consecutive series of individual bed sections.

16. In an apparatus for cutting limp sheet material as defined in claim 15 further including vacuum generating means connected with the consecutive series of individual bed sections and having vacuum control means for drawing a vacuum within the sections selectively in response to the positioning of the cutting blade relative to the individual sections.

17. In an apparatus for cutting limp sheet material as defined in claim 16 wherein the panel actuating means and the vacuum control means are responsive to movement of the carriage.

18. In an apparatus for cutting limp sheet material as defined in claim 10 wherein:

the air-impermeable vacuum bed is mounted on a movable conveyor and the conveyor is supported by a stationary table; and the panel of the partitioning means is mounted on the conveyor for movement with the vacuum bed in both the raised and lowered postiions.

19. In an apparatus for cutting limp sheet material as defined in claim 10, the improvement wherein:

the air-permeable vacuum bed is mounted on a movable conveyor and includes a plurality of panel-receiving slots extending generally transverse to the direction of movement of the conveyor;

the conveyor is mounted for movement on a stationary frame; and the panel of the partitioning means is supported in the stationary frame for movement from a lowered position non-interfering with the conveyor and the vacuum bed and a raised position in one of the slots of the vacuum bed.

* * * * *